US010076829B2

(12) United States Patent
Sun

(10) Patent No.: US 10,076,829 B2
(45) Date of Patent: Sep. 18, 2018

(54) MULTIFUNCTIONAL SCREWDRIVER

(71) Applicant: Shanghai Easy-Use Tools Enterprise Co. Ltd., Shanghai (CN)

(72) Inventor: Shiyu Sun, Shanghai (CN)

(73) Assignee: SHANGHAI EASY-USE TOOLS ENTERPRISE CO. LTD., Shanghai (CN)

( * ) Notice: Subject to any disclaimer, the term of this patent is extended or adjusted under 35 U.S.C. 154(b) by 90 days.

(21) Appl. No.: 15/259,758

(22) Filed: Sep. 8, 2016

(65) Prior Publication Data

US 2017/0197299 A1 Jul. 13, 2017

(30) Foreign Application Priority Data

Jul. 8, 2015 (CN) ..... 2015 2 0491140 U

(51) Int. Cl.

| | |
|---|---|
| ***B25B 15/04*** | (2006.01) |
| ***B25B 13/46*** | (2006.01) |
| ***B25G 1/06*** | (2006.01) |
| ***B25B 23/16*** | (2006.01) |

(52) U.S. Cl.

CPC ..... *B25B 15/04* (2013.01); *B25B 13/463* (2013.01); *B25B 23/16* (2013.01); *B25G 1/063* (2013.01)

(58) Field of Classification Search

CPC ..... B25B 23/16
USPC ..... 81/60
See application file for complete search history.

(56) References Cited

U.S. PATENT DOCUMENTS 2,891,434 A * 6/1959 Lozensky ..... B25B 13/463 81/60
3,575,069 A * 4/1971 White ..... B25B 13/463 81/177.2
3,709,073 A * 1/1973 Kurtz ..... B25B 13/08 76/114
4,748,874 A * 6/1988 Sharp ..... B25B 13/461 81/177.2
6,263,766 B1 * 7/2001 Jarvis ..... B25B 23/0021 81/177.2
6,318,216 B1 * 11/2001 Eggert ..... B25B 13/04 81/124.3
6,938,521 B1 * 9/2005 Skeens ..... B25B 13/461 81/177.2
6,976,408 B2 * 12/2005 Chen ..... B25B 13/462 81/58

(Continued)

*Primary Examiner* — Hadi Shakeri
(74) *Attorney, Agent, or Firm* — Duane Morris LLP; Gregory M. Lefkowitz; Jason M. Nolan

(57) ABSTRACT

This disclosure discloses a multifunctional screwdriver, comprising a handle, wherein an end of the handle is detachably inserted with a matching shaft; a ratchet head, in which a matching hole is provided, and the matching shaft is detachably inserted in the matching hole; the ratchet head includes a ratchet shell, a ratchet cap, ratchet teeth, and a plurality of reinforcing rings provided in the ratchet shell, the ratchet teeth pass through the plurality of the reinforcing rings and are fixed on a cylinder in the ratchet shell, the ratchet cap seals the ratchet teeth and the plurality of the reinforcing rings within said ratchet shell, internal of said ratchet shell is also provided with a ratchet mechanism. This disclosure solves the problem that screws/nails may rotate reversely during the operation process and effectively improves the work efficiency of the screwdriver.

8 Claims, 7 Drawing Sheets

(56) References Cited

U.S. PATENT DOCUMENTS 7,444,908 B2 * 11/2008 Lin ..... B25G 1/105
81/177.2

* cited by examiner

MULTIFUNCTIONAL SCREWDRIVER

CROSS-REFERENCE TO RELATED APPLICATIONS

The present application claims priority to and the benefit of Chinese Patent Application No. CN 201520491140.3, filed on Jul. 8, 2015, the entire content of which is incorporated herein by reference.

BACKGROUND OF THE INVENTION

1. Field of the Invention

The present patent application relates to the field of hardware, more specifically, to a multifunctional screwdriver.

2. Description of the Related Art

The existing screwdriver provides a lot of conveniences to people's life, which is mainly used to fasten or loosen screws. The most common screwdriver in prior art generally includes a screwdriver handle, a screwdriver rod and a screwdriver head, and the screwdriver, screwdriver rod and screwdriver head are fixed as an one-piece structure. When using the screwdriver, the user has to constantly loose or clench the palm of his/her hand, which allows the palm to be located at a position easy to apply force. When the user are loosing or clenching the palm, the screwdriver head is easily separated from the screw, so it is very inconvenient to operate the screwdriver.

SUMMARY OF THE PATENT APPLICATION

In view of this, in order to solve the problem that the existing conventional screwdrivers are not convenient to use, the present patent application provides a multifunctional screwdriver.

In order to achieve the objectives disclosed above, the present patent application provides a multifunctional screwdriver comprising:

a handle, an end of said handle being detachably inserted with a matching shaft, a ratchet head, in which a matching hole is provided, and said matching shaft being detachably inserted in said matching hole;

wherein, said ratchet head includes a ratchet shell, a ratchet cap, ratchet teeth, and a plurality of reinforcing rings provided in said ratchet shell, said ratchet teeth pass through the plurality of reinforcing rings and are fixed on a cylinder in said ratchet shell, said ratchet cap seals said ratchet teeth and the plurality of reinforcing rings within said ratchet shell, internal of said ratchet shell is provided with a ratchet mechanism.

Preferably, the multifunctional screwdriver as disclosed above, wherein said ratchet mechanism includes said ratchet teeth, a pawl, a reversing paddle, spring leaf, and pin shaft, said pawl is fit and assembled with said reversing paddle, the reversing paddle passes through and is projected from said ratchet shell, said pawl is meshing contacted with external circular surface of said ratchet teeth and has an inner rim surface and an outer rim surface, said pin shaft is inserted in said ratchet shell and closely adjacent to the inner rim surface of said pawl, said spring leaf is contacted with the outer rim surface of said pawl.

Preferably, the multifunctional screwdriver as disclosed above, wherein bottom of said reversing paddle is provided with a groove, top of said pawl is provided with a boss, said reversing paddle is assembled to said pawl through said boss and said groove.

Preferably, the multifunctional screwdriver as disclosed above, wherein center of each of said reinforcing rings is provided with a mounting hole therethrough, contour of said mounting hole is matched with assembly of said ratchet teeth, said pawl, and said spring leaf.

Preferably, the multifunctional screwdriver as disclosed above, wherein two ends of said spring leaf are fixed in said mounting hole.

Preferably, the multifunctional screwdriver as disclosed above, wherein said ratchet shell is provided with a through-hole therethrough, said reversing paddle is installed in said through-hole.

Preferably, the multifunctional screwdriver as disclosed above, wherein said ratchet shell is provided with a plurality of internal thread holes therein, each of said reinforcing rings and said ratchet cap are provided with a plurality of through-holes at positions aiming at said thread holes, and said ratchet shell, said reinforcing rings, and said ratchet cap are fixed by screws.

Preferably, the multifunctional screwdriver as disclosed above, wherein a spring and a steel ball are provided in head of said ratchet teeth.

Preferably, the multifunctional screwdriver as disclosed above, wherein bottom of said handle has a ratchet mounting hole matched with head of said ratchet teeth in structure; top of said matching shaft has an hex socket hole.

Positive effects of the present patent application are as follows:

The multifunctional screwdriver of the present patent application is provided with a ratchet mechanism in its ratchet head, and the ratchet head is coordinated with the handle when used, which allows the operation of loosening or fastening the screws/nails, greatly improves the torque and reduces the power output from users, and thus saves physical capacity; by the ratchet mechanism, during the operation process, the screws/nails will rotate either clockwise or anticlockwise, which solves the problem that screws/nails may rotate reversely during the operation process and effectively improves the work efficiency of the screwdriver.

BRIEF DESCRIPTIONS OF THE DRAWINGS

To further illustrate the present patent application with the drawings and embodiments as follows.

DESCRIPTIONS OF THE PREFERRED EMBODIMENTS

Figure 1:
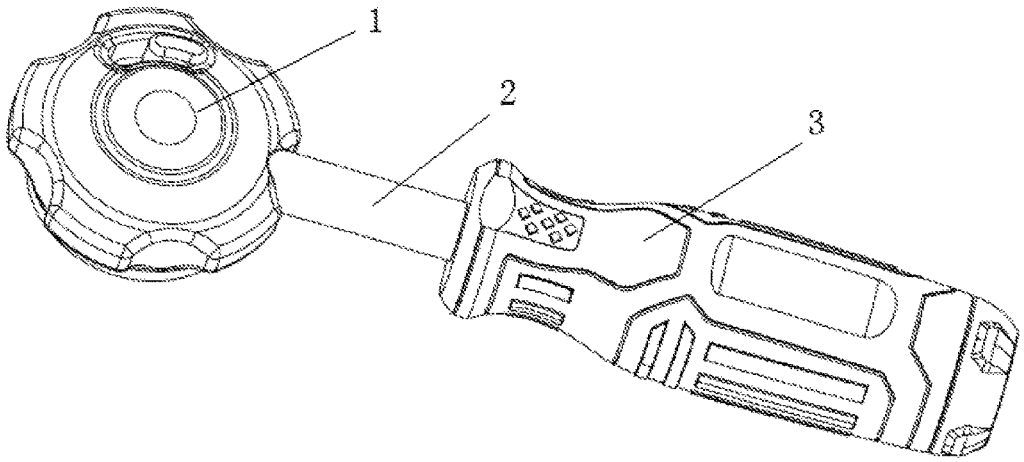
FIG. 1 shows a three-dimensional view of a certain perspective of the multifunctional screwdriver according to the first embodiment.

Hereinafter, certain embodiments according to the present patent application will be described with reference to the accompanying drawings below, but do not limit the scope of the present patent application.

First Embodiment

Please refer to FIGS. 1 to 10 which show a multifunctional screwdriver of a preferred embodiment, the screwdriver comprises:

As shown in FIGS. 1 to 4, a handle 3, an end of the handle 3 being detachably inserted with a matching shaft 2, preferably, the specifications of the matching shaft 2 can be elected or changed by the skilled in art according to situations.

A ratchet head 1, the ratchet head 1 being provided with a matching hole 6, and the matching shaft 2 being detachably inserted in the matching hole 6;

as shown in FIGS. 5 to 10, the ratchet head 1 comprises a ratchet shell 11, a ratchet cap 12, ratchet teeth 13, and a plurality of reinforcing rings 14 which are installed in the ratchet shell 11, and the ratchet shell 11 has a positioning block 141 inside which is used for positioning the reinforcing rings so that it will not rotate in use. The ratchet teeth 13 pass through the plurality of reinforcing rings 14 and are fixed on a cylinder 131 in the ratchet shell 11 to allow the ratchet teeth 13 to rotate in 360° relative to the cylinder 131. The ratchet cap 12 seals the ratchet teeth 13 and the plurality of reinforcing rings 14 in the ratchet shell 11, wherein the internal of the ratchet shell 11 is also provided with a ratchet mechanism, through which the screwdriver can rotate either clockwise or anticlockwise during its operation. Therefore, a reverse rotation will not occur, which effectively improves the work efficiency of the screwdriver.

The patent application further comprises the following embodiments on the basis of the foresaid disclosure, please continue to refer to FIGS. 1 to 10, In a further embodiment of the present patent application, the ratchet mechanism includes the ratchet teeth 13, the pawl 15, the reversing paddle 16, the spring leaf 17 and the pin shaft 18, and the pawl 15 is fit and assembled with the reversing paddle 16. Preferably, the bottom of the reversing paddle 16 is provided with a groove 161, and the top of the pawl 15 is provided with boss 153, and the reversing paddle 16 is assembled to the pawl 15 through the boss 153 and the groove 161.

Figure 9:
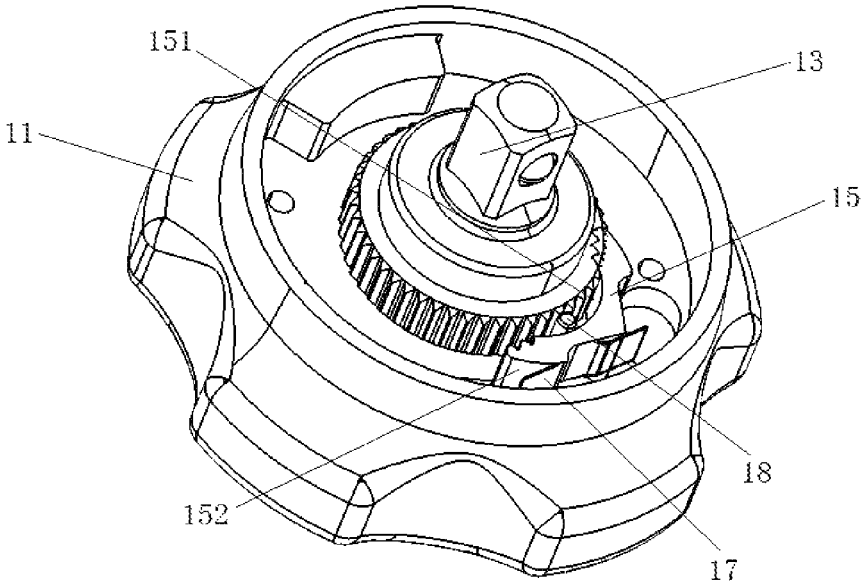
FIG. 9 shows an assembly diagram of the ratchet mechanism and the ratchet shell according to the first embodiment.
Figure 10:
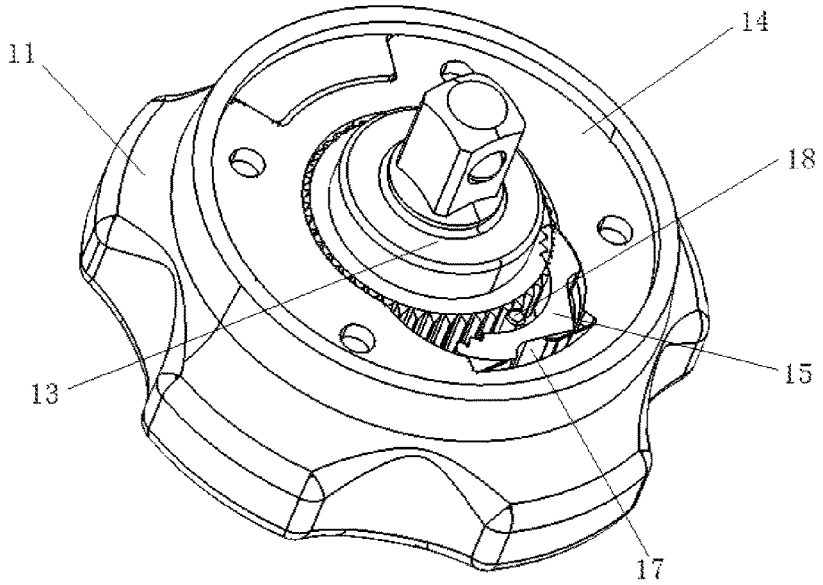
FIG. 10 shows a three-dimensional view of the ratchet head whose ratchet head removed based on the first embodiment.

The reversing paddle 16 passes through and is projected from the ratchet shell 11, and the pawl 15 is meshing contacted with the external circular surface of the ratchet teeth 13. The pawl 15 is provided with an inner rim surface 151 and an outer rim surface 152 (as shown in FIG. 9), and the pin shaft 18 is inserted in the pin shaft mounting hole 181 of the ratchet shell 11 and is closely adjacent to the inner rim surface 151 of the pawl 15. The spring leaf 17 is contacted to the outer rim surface 152 of the pawl 15.

In a further embodiment of the present patent application, center of each of said reinforcing rings 14 is provided with a mounting hole 141 therethrough, and the contour of the mounting hole 141 is matched with the assembly of the ratchet teeth 13, the pawl 15 and the spring leaf 17.

In a further embodiment of the present patent application, the two ends of the spring leaf 17 are fixed in the mounting hole 141, specifically, the spring leaf 17 has a protrusion. The outer rim surface of the pawl 15 is also a protrusion structure, and since the spring leaf is flexible, it allows the protrusion of the spring leaf 17 to locate at left or right of the pawl 15 (as shown in FIG. 9).

Figure 6:
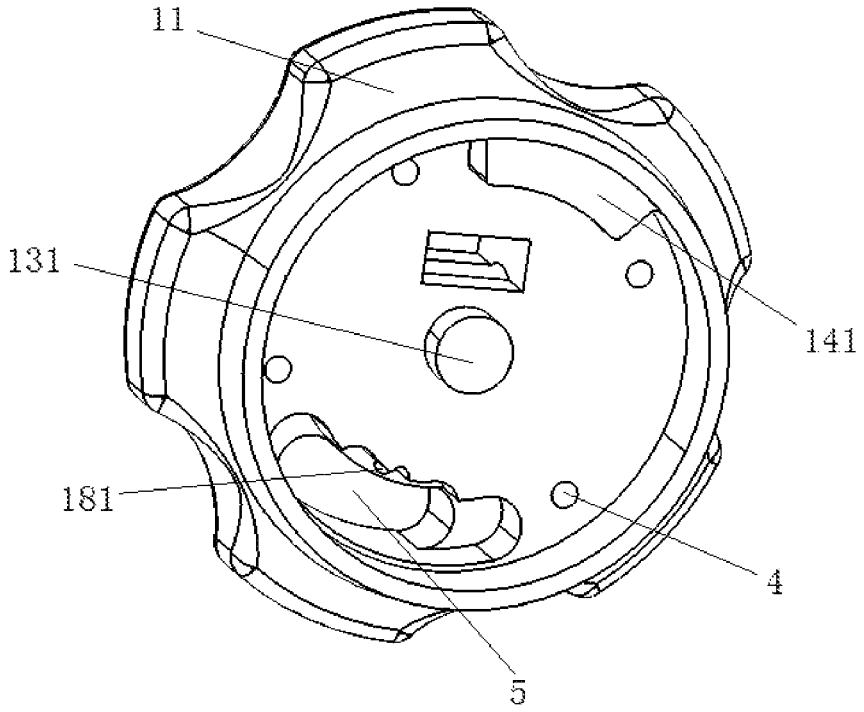
FIG. 6 shows a structure diagram of the ratchet shell according to the first embodiment.
Figure 7:
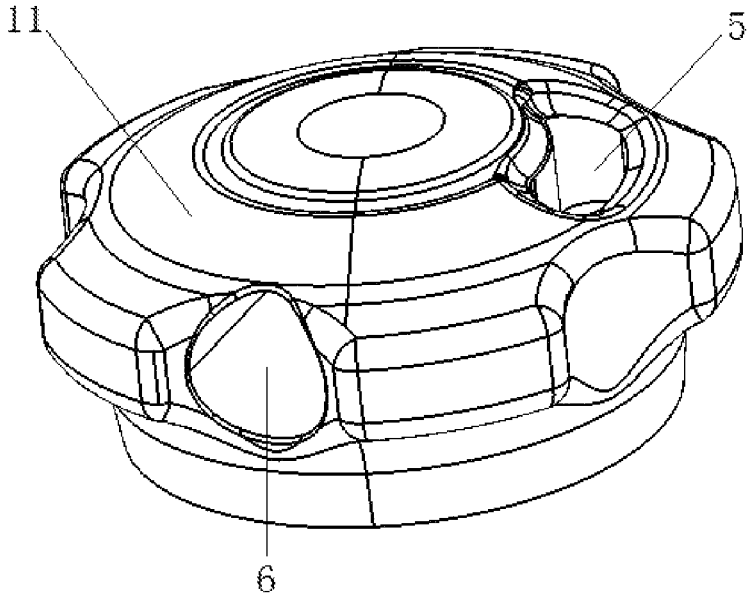
FIG. 7 shows a position relation diagram of the matching hole and the through-hole on the ratchet shell according to the first embodiment.
Figure 8:
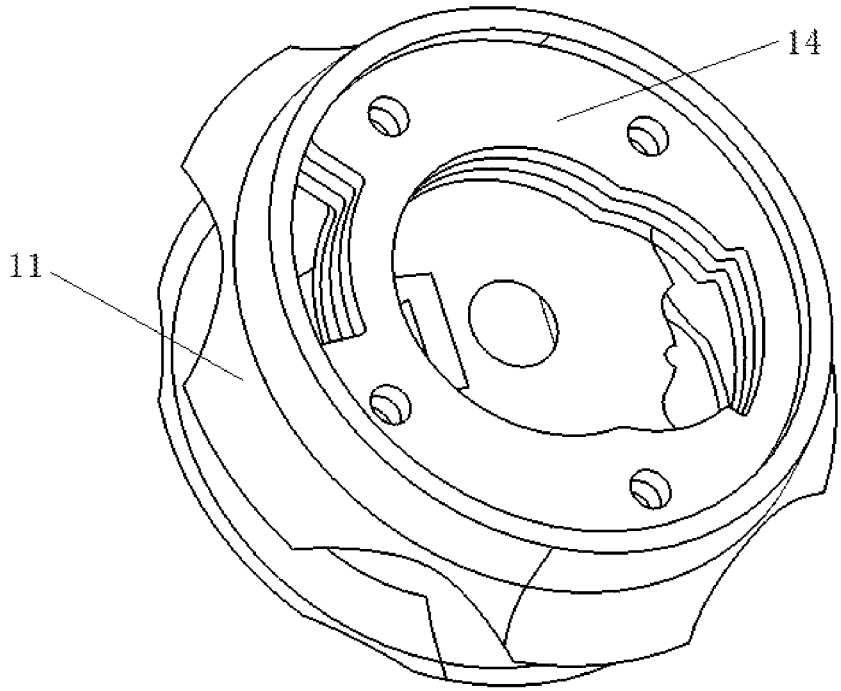
FIG. 8 shows an assembly diagram of the reinforcing rings and the ratchet shell according to the first embodiment.

In a further embodiment of the present patent application, the ratchet shell 11 is provided with a through-hole 5 passing through the ratchet shell 11 (as shown in FIG. 6), the reversing paddle 16 is installed in the through-hole 5, by controlling the reversing paddle 16 protruded from the ratchet shell 11, it is possible to control the relative position relationship of the spring leaf 16 and the pawl 15, and thus to control the rotation direction of the screwdriver during the operation.

In a further embodiment of the present patent application, the ratchet shell 11 is provided with a plurality of inner thread holes 4 (as shown in FIG. 6) inside, each of the reinforcing rings 14 and the ratchet cap 12 are provided with a plurality of through-holes 7 at positions aiming at the thread holes 4, and the ratchet shell 11, the reinforcing rings 14, and the ratchet cap 12 are fixed by screws (not shown).

In a further embodiment of the present patent application, the head of the ratchet teeth 13 is provided with a spring 191 and a steel ball 19 therein.

Figure 3:
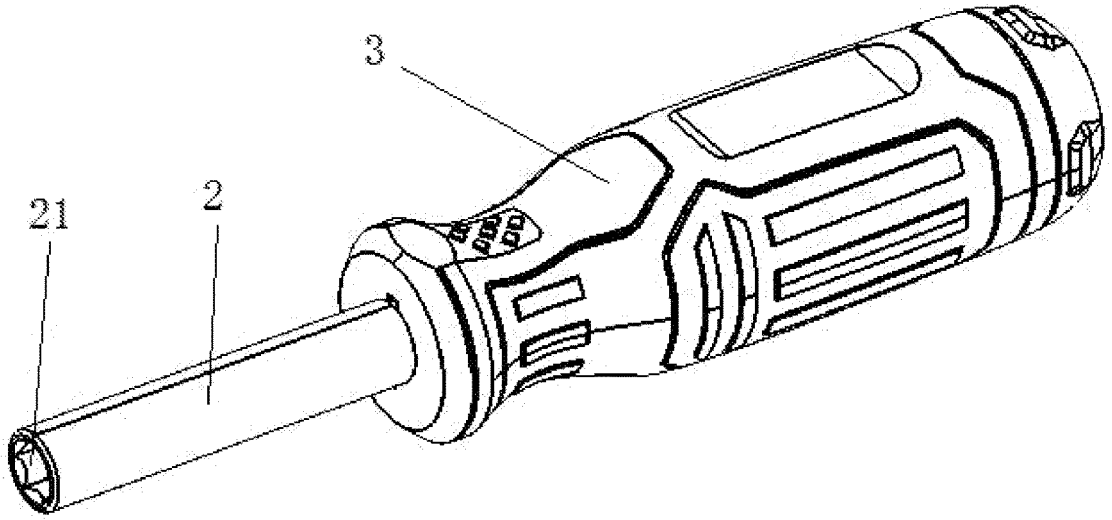
FIG. 3 shows a structure diagram of a certain perspective of the handle according to the first embodiment.
Figure 4:
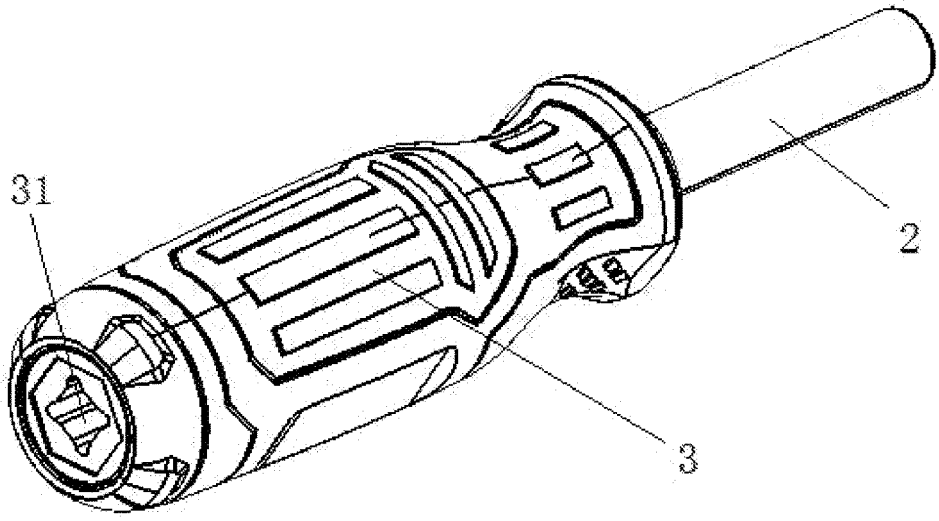
FIG. 4 shows a structure diagram of another perspective of the handle according to the first embodiment.
Figure 5:
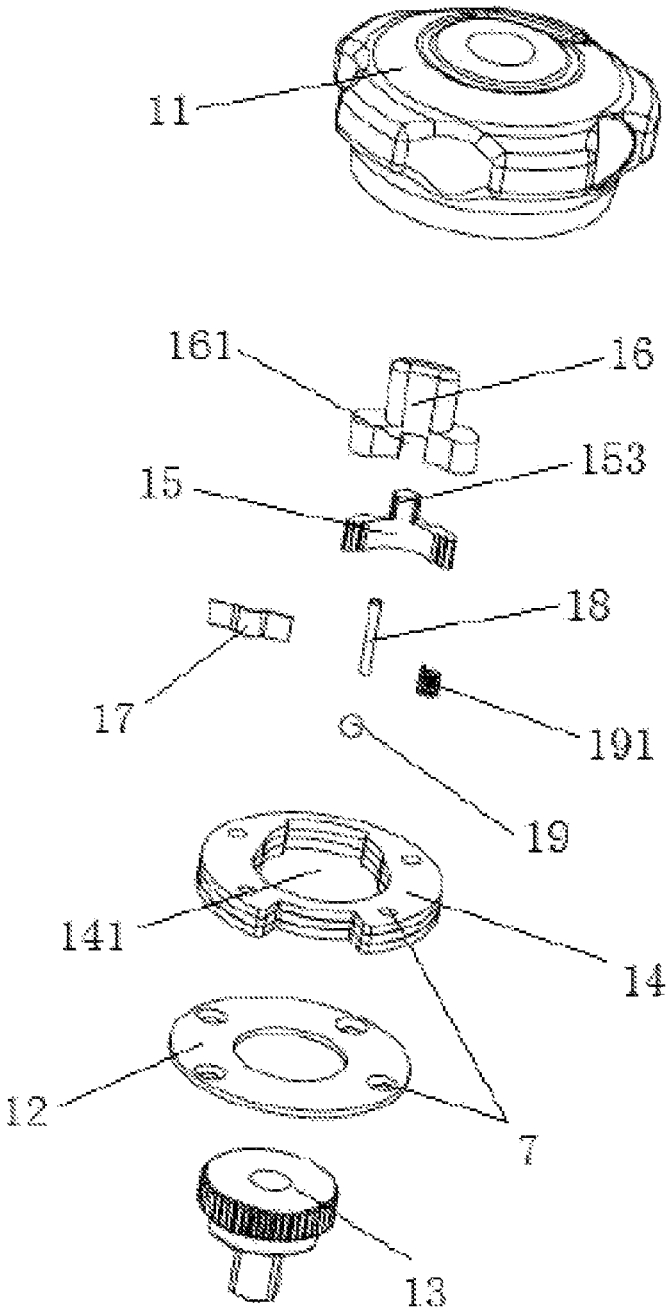
FIG. 5 shows an exploded view of the ratchet head according to the first embodiment.

In a further embodiment of the present patent application, the bottom of the handle 3 has a ratchet mounting hole 31 matched with head of the ratchet teeth 13 in structure; the top of the matching shaft 2 has an hex socket hole 21 (as shown in FIGS. 3 and 4).

The users can further understand the characteristics and functions of the present patent application according to the following illustrations.

Figure 2:
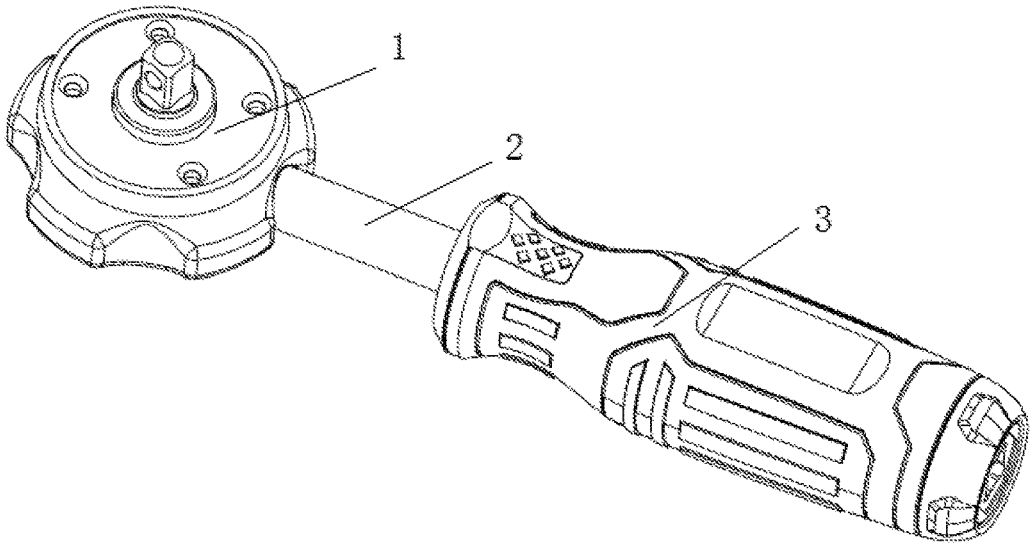
FIG. 2 shows a three-dimensional view of another perspective of the multifunctional screwdriver according to the first embodiment.

The multifunctional screwdriver of the present patent application provides a method of operation as follows:

Step 1: inserting the matching shaft 2 in the matching hole 6 of the ratchet head 1 (as shown in FIGS. 1 and 2) to form a multifunctional screwdriver structure, and adjusting the position of the reversing paddle 16 to ensure the rotation direction of the screwdriver;

Step 2: inserting the head of the ratchet teeth 13 in the socket head screw, and fixing the head of the ratchet teeth 13 in the socket head screw by the spring 191 and the steel ball 19 to prevent from falling off during the operation;

Step 3: horizontally rotating the screwdriver, and tightening or loosening the screw in a single direction through the ratchet mechanism.

Step 4: adjusting the relative position of the reversing paddle 16 when a change of rotation direction is required.

In conclusion, the multifunctional screwdriver of the present patent application is configured with a ratchet mechanism in the ratchet head, and the ratchet head is coordinated with the handle when used, which allows the operation of loosening or fastening the screws/nails, greatly improves the torque and reduces the power output from users, and thus saves physical capacity; by the ratchet mechanism, during the operation process, the screws/nails will rotate either clockwise or anticlockwise, which solves the problem that screws/nails may rotate reversely during the operation process and effectively improves the work efficiency of the screwdriver.

Second Embodiment

Figure 11:
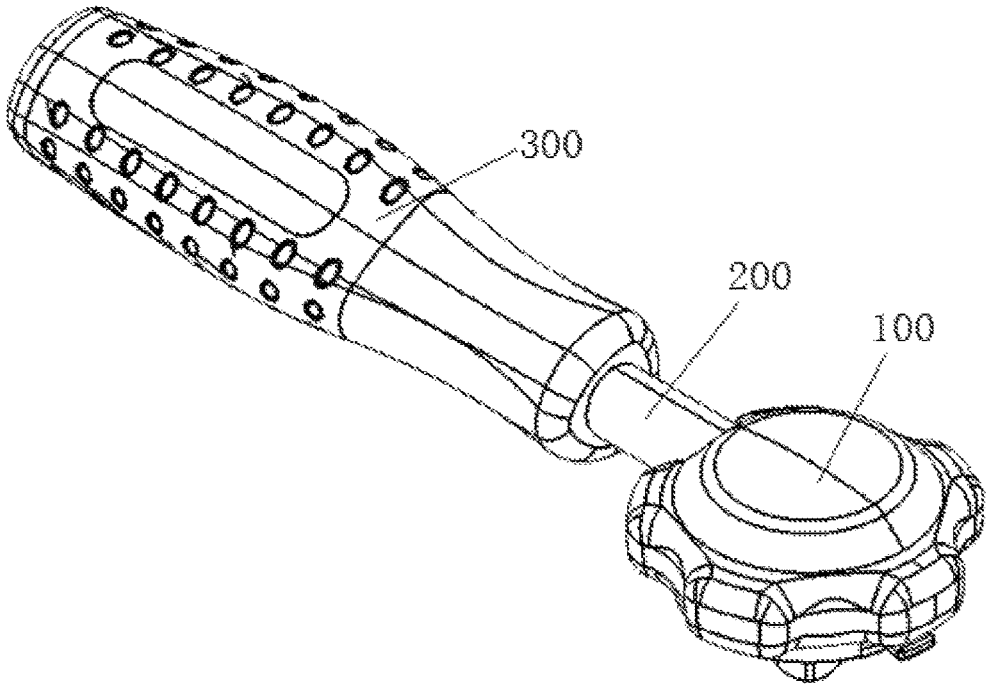
FIG. 11 shows a three-dimensional view of the multifunctional screwdriver in a first state of operation according to the second embodiment.
Figure 12:
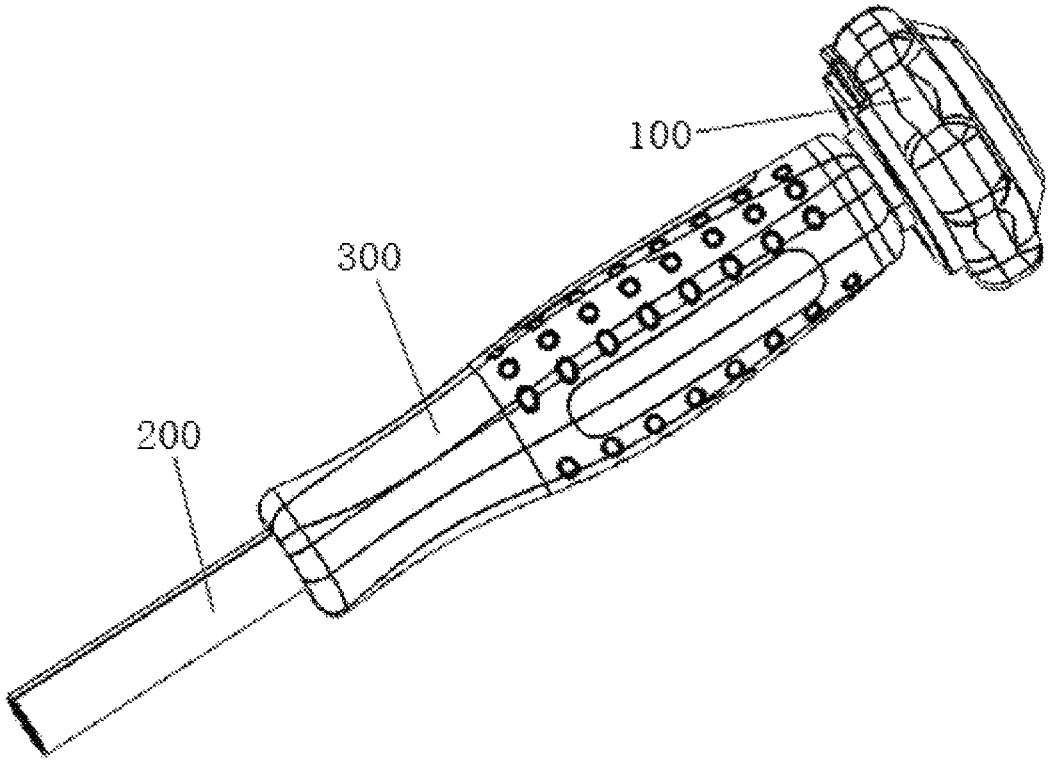
FIG. 12 shows a three-dimensional view of the multifunctional screwdriver in a first state of operation according to the second embodiment.

As shown in FIGS. 11 and 12, in the present embodiment, the basic structure of the multifunctional screwdriver is the same as that in the first embodiment, specifically, the multifunctional screwdriver also includes a ratchet head 100, a matching shaft 200, and a handle 300, but the only difference is that: the ratchet head 100 in the present embodiment is a common palm ratchet head without a ratchet mechanism, when inserting the matching shaft 200 in the ratchet head 100, the user can tighten or loosen the screws in a horizontal direction, which also can reach the same technical effect as that of the first embodiment. The specific embodiments are the same as those of the first embodiment, and thus they are omitted.

Moreover, the head of the pawl of the ratchet head 100 in the present embodiment can be inserted into the bottom of the handle. The user can hold the ratchet head 100 with his/her hands to rotate, in order to tighten or loosen the screws.

The above mentioned is merely the better embodiment of the patent application, the implementation method and the protection scope of the patent application are not limited by that, for artisan in this field, it is to be understood that the equivalent replacement and the obvious change of the specification and the illustrations of the present patent application shall be included in the protection scope of the present patent application.

What is claimed is:

1. A multifunctional screwdriver, comprising:

a handle, an end of said handle being detachably inserted with a matching shaft, a ratchet head, in which a matching hole is provided, and said matching shaft being detachably inserted in said matching hole;

wherein, said ratchet head includes a ratchet shell, a ratchet cap, ratchet teeth, and a plurality of reinforcing rings provided in said ratchet shell, said ratchet teeth pass through the plurality of reinforcing rings and are fixed on a cylinder in said ratchet shell, said ratchet cap seals said ratchet teeth and the plurality of reinforcing rings within said ratchet shell, internal of said ratchet shell is provided with a ratchet mechanism; and wherein said ratchet mechanism includes said ratchet teeth, a pawl, a reversing paddle, a spring leaf, and a pin shaft, said pawl is fit and assembled with said reversing paddle, the reversing paddle passes through and is projected from said ratchet shell, said pawl is meshing contacted with external circular surface of said ratchet teeth and has an inner rim surface and an outer rim surface, said pin shaft is inserted in said ratchet shell and closely adjacent to the inner rim surface of said pawl, said spring leaf is contacted with the outer rim surface of said pawl.

2. The multifunctional screwdriver as disclosed in claim 1, wherein bottom of said reversing paddle is provided with a groove, top of said pawl is provided with a boss, said reversing paddle is assembled to said pawl through said boss and said groove.

3. The multifunctional screwdriver as disclosed in claim 1, wherein center of each of said reinforcing rings is provided with a mounting hole therethrough, contour of said mounting hole is matched with assembly of said ratchet teeth, said pawl, and said spring leaf.

4. The multifunctional screwdriver as disclosed in claim 3, wherein two ends of said spring leaf are fixed in said mounting hole.

5. The multifunctional screwdriver as disclosed in claim 1, wherein said ratchet shell is provided with a through-hole therethrough, said reversing paddle is installed in said through-hole.

6. The multifunctional screwdriver as disclosed in claim 1, wherein said ratchet shell is provided with a plurality of internal thread holes therein, each of said reinforcing rings and said ratchet cap are provided with a plurality of through-holes at positions aiming at said thread holes, and said ratchet shell, said reinforcing rings, and said ratchet cap are fixed by screws.

7. The multifunctional screwdriver as disclosed in claim 1, wherein a spring and a steel ball are provided in head of said ratchet teeth.

8. The multifunctional screwdriver as disclosed in claim 1, wherein bottom of said handle has a ratchet mounting hole matched with head of said ratchet teeth in structure; top of said matching shaft has a hex socket hole.

* * * * *